US007772750B2

(12) United States Patent
Lovett et al.

(10) Patent No.: US 7,772,750 B2
(45) Date of Patent: Aug. 10, 2010

(54) LARGE PAR LAMP EXHIBITING EXCELLENT COLOR WITH IMPROVED EFFICACY AND LIFE

(75) Inventors: David Lovett, Barlestone (GB); Roger Alan Hume, Melton Mowbray (GB)

(73) Assignee: General Electric Company, Schenectady, NY (US)

( * ) Notice: Subject to any disclaimer, the term of this patent is extended or adjusted under 35 U.S.C. 154(b) by 430 days.

(21) Appl. No.: 11/509,526

(22) Filed: Aug. 24, 2006

(65) Prior Publication Data

US 2008/0048542 A1 Feb. 28, 2008

(51) Int. Cl.
*H01J 3/16* (2006.01)

(52) U.S. Cl. ..... 313/113; 362/306

(58) Field of Classification Search ..... 313/113, 313/318.11, 318.12; 362/306, 217.06, 296.08, 362/350

See application file for complete search history.

(56) References Cited

U.S. PATENT DOCUMENTS 2,596,697 A * 5/1952 Krefft ..... 313/114
3,688,149 A * 8/1972 Pitkjaan ..... 313/114
4,015,158 A 3/1977 Roller et al.
4,906,887 A * 3/1990 Scholz et al. ..... 313/25
4,914,342 A * 4/1990 Mujahid et al. ..... 313/113
5,128,851 A * 7/1992 Kosmatka et al. ..... 362/390
6,111,359 A 8/2000 Work et al.
6,376,992 B1 * 4/2002 Petrick ..... 315/82
6,382,816 B1 5/2002 Zhao et al.

FOREIGN PATENT DOCUMENTS

EP 160 242 B1 11/1985
EP 1 503 137 A2 2/2005

OTHER PUBLICATIONS

PCT/US2007/074459 International Search Report, mailed Nov. 14, 2008.

* cited by examiner

*Primary Examiner*—Nimeshkumar D. Patel
*Assistant Examiner*—Christopher M Raabe
(74) *Attorney, Agent, or Firm*—Fay Sharpe LLP

(57) ABSTRACT

A lamp assembly (20) includes a ceramic metal halide lamp (22) mounted in a reflector (60) with support assembly (62). First frame portions (64) of the support assembly (which include linear first portions (64*a*), angled second portions (64*b*), and offset portions (64*c*)) are bent approximately ninety degrees at one end and merge into second frame portions (66) that extend parallel to the lamp. The arrangement supports the light source in the PAR lamp in a transverse manner. In a second embodiment, the frame portions (62') extend along either side of the light source to accurately position the light source relative to the reflector.

12 Claims, 2 Drawing Sheets

LARGE PAR LAMP EXHIBITING EXCELLENT COLOR WITH IMPROVED EFFICACY AND LIFE

BACKGROUND OF THE INVENTION

This disclosure relates to large parabolic aluminized reflector (PAR) lamps (e.g., PAR56 and PAR64, where the number following PAR represents the diameter of the widest part of the lamp in eighths of an inch), which lamps are widely used in the specialty market such as for accent and retail lighting, lobbies, corridors, etc.

Historically, this market employs an incandescent light source such as a halogen light source where the light source filament is oriented vertically (or parallel) to the center beam axis of the lamp. This orientation makes it easier to direct light with a reflector and improves optical control. The filament of the halogen light source is usually enclosed in a capsule to maintain the halogen cycle (tungsten evaporating from the filament, tungsten combining with the halogen (such as iodine, bromine, chlorine, or fluorine) and prevent the tungsten from contacting the lamp wall and blackening the wall surface). Halogen light sources are desirable because of the excellent color light but have a relatively short life and low efficacy.

Although quartz metal halide lamp sources may improve efficacy and life, these improvements are offset by the significant reduction in color quality. It is known that ceramic metal halide (CMH) light sources provide high efficacy, longer life, and good color. In other words, the ceramic metal halide light source combines the advantages of both halogen and quartz light sources with none of the significant drawbacks. In fact, CMH arctubes have been incorporated into smaller PAR reflectors (PAR20, PAR 30, AND PAR 38) for general, commercial lighting for several years. CMH lamps operate better in a horizontal position (as opposed to quartz lamps that are better operated in a vertical orientation as noted above).

Although it has been suggested to replace the quartz light source in a large PAR environment, there are physical constraints that preclude a simple substitution of one type of light source for another. For example, mounting a 150 Watt CMH arctube capsule into a large PAR reflector encounters the issue of size and mounting of the arctube, as well as a preferred direction of operation of the lamp. Specifically, a PAR56 reflector is wide and rather shallow. Thus, an elongated 150 W CMH lamp will not fit within the reflector, i.e., one end of the light source will extend axially outward from an outer end of the lamp. Moreover, mounting the 150 W CMH arctube light source along the axis of the lamp is not as desirable for optimal operation of the light source as noted above. It also becomes important to position the light source at the correct distance from the back of the reflector in order to eliminate or limit distortion from the ideal beam pattern.

In the environment of the even larger PAR64 lamp, heretofore incorporation of a 150 W CMH light source or arctube has simply not been adopted. There is slightly greater depth to the PAR64 reflector and thus the elongated 150 W CMH light source capsule will fit in an axial direction, that is, along the lamp axis. However, seemingly there has been no introduction of the 150 W light source into the PAR64 market.

Thus a need exits to create a large PAR specialty lamp (on the PAR56 and PAR64 scale) with attributes such as excellent color, efficacy, life, and accurate location of the light source in the reflector.

BRIEF DESCRIPTION OF THE INVENTION

A preferred embodiment relates to a 150 watt CMH light source having an elongated, first axial dimension. A shallow parabolic reflector having a focal point located along an axis of revolution of the reflector, and between a base end of the reflector and an open end of the reflector has a reflecting surface adapted to receive light from the light source and direct the light in a predetermined manner through the open end of the reflector. The reflector has a second, depth dimension measured along the axis of revolution wherein the second dimension is less than the first dimension of the light source; and the light source is disposed substantially perpendicular to the axis of the reflector at the focal point thereof.

The light source is located between first and second frame members.

The frame members each have a first portion extending through the reflector surface in a first direction (z direction) generally parallel to the axis of revolution.

Each frame member includes a second portion extending in a second direction (y direction) substantially perpendicular to the first portion.

Each frame member includes a third portion interposed between the first and second portions, the third portion extending in a third direction (x direction) to accommodate a cross-sectional dimension of the light source and capsule disposed between the second portions of the first and second frame members.

A primary advantage resides in the ability to accommodate a CMH light source in a large PAR lamp.

Another advantage is realized by the robust mounting of the CMH light source transverse to the axis of revolution of the lamp reflector.

Still another advantage relates to the robust manner of mounting the light source in the lamp assembly.

Still other features and advantages will become apparent upon reading and understanding the following detailed description.

DETAILED DESCRIPTION OF THE INVENTION

Figure 1:
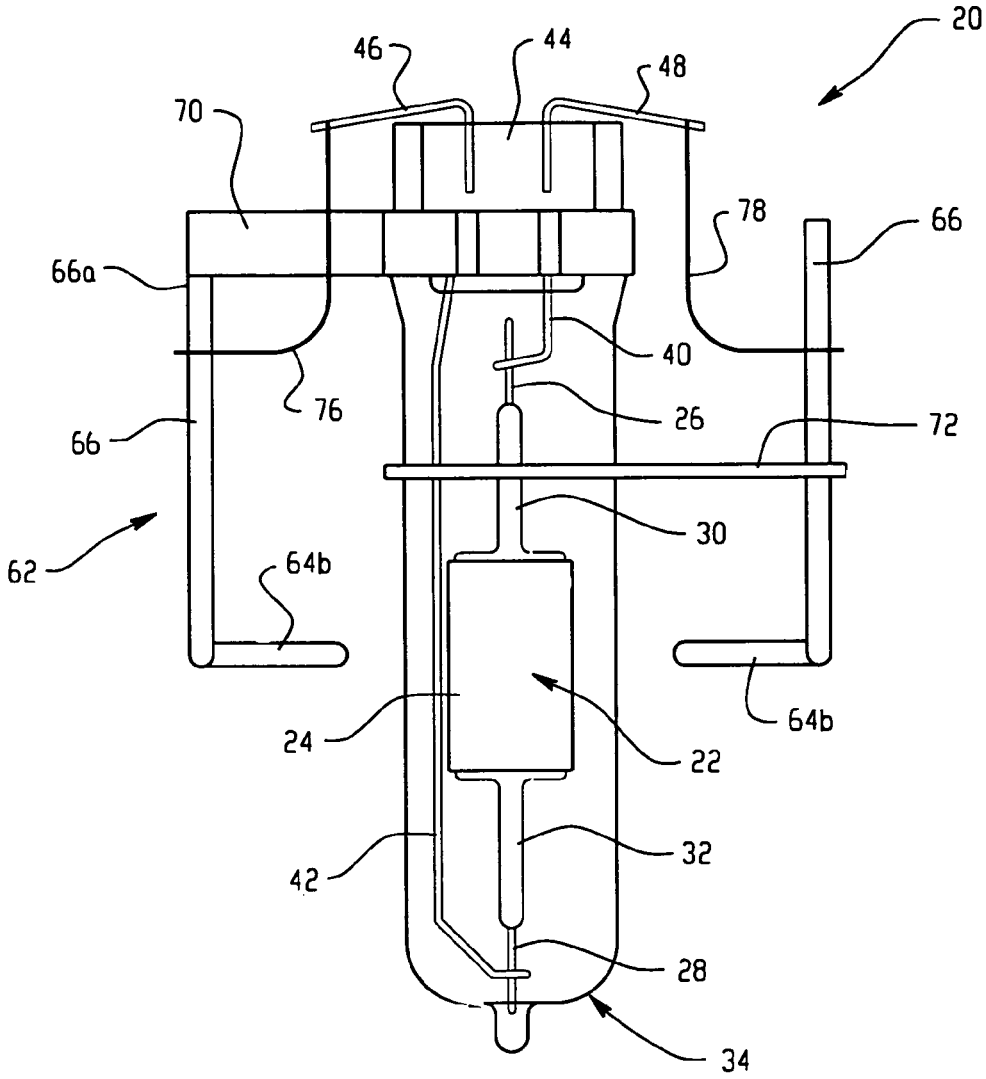
FIG. 1 is a top view of the arctube mount with frame components.

Turning to FIGS. 1-4, a lamp assembly 20 is shown and includes a light source 22, particularly a ceramic metal halide (CMH) lamp, the particular details of the structure and operation of which are well known in the art so that a complete description herein is unnecessary to a full understanding of the present invention. Briefly, and for purposes of coordinating the following description, the CMH light source 22 has a central body 24 that receives a fill and spaced electrodes 26, 28 therein. The electrodes have lead portions that extend through the legs, shown in this embodiment as first and second legs 30, 32 that extend in opposite axial directions from the central body 24. The legs are sealed to the body in any conventional manner.

The light source 22 is received in a light transmissive capsule 34 that encapsulates the CMH body, legs, and electrodes, and the capsule shown here is a single-ended structure that protects inner lead portions 40, 42 that respectively connect electrically and mechanically with the leads 26, 28 extending from the first and second legs. The inner lead portions 40, 42, on the other hand, support the body in the capsule, and also interconnect through a sealed region 44 (press sealed or pinch sealed, for example) with planar conductive regions such as thin, molybdenum foils (not shown) that electrically connect with outer leads 46, 48. The inner lead portion 42 is substantially longer in length than the inner lead portion 40 since it mechanically connects the remote end leg 32 with the sealed region 44. Of course, it will be understood that the legs 30, 32 are illustrated in linear relation, and that other configurations may be used without departing from the scope and intent of this application.

Figure 4:
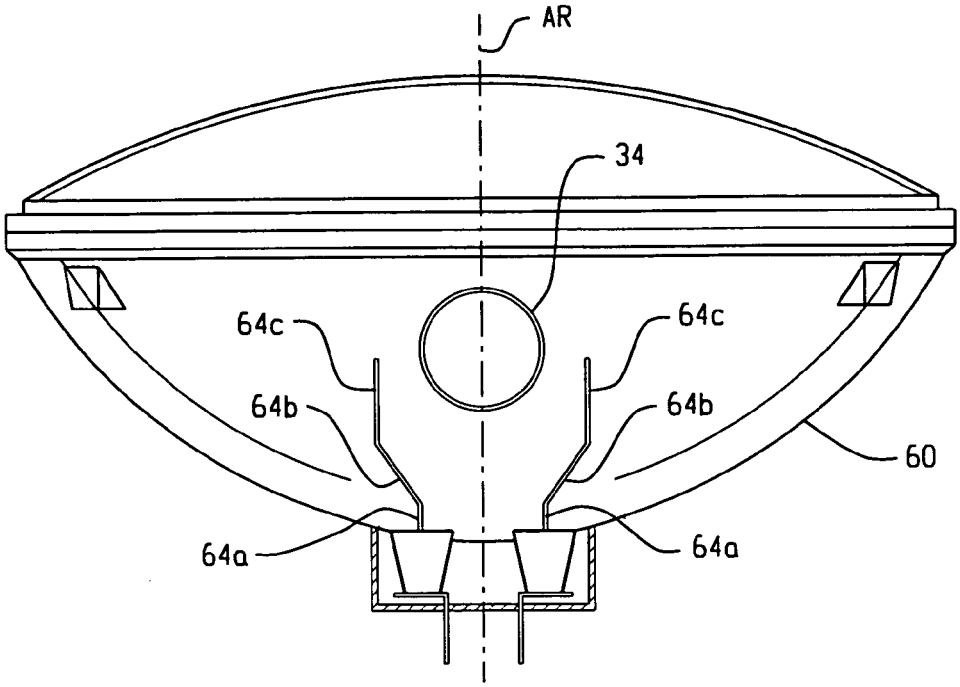
FIG. 4 is a side view of a PAR56 lamp with an arctube capsule centered between frame support components.

Generally, the light source structure described above is conventional. Because of the shallow depth of the reflector in the PAR56 lamp, the light source capsule 34 is mounted in the transverse direction to the axis of revolution AR of reflector 60 (i.e., parabolic reflector in a PAR lamp) of the lamp assembly 20 (FIG. 4). This is achieved with a new robust mounting or support assembly 62, the particular details of which are illustrated in each of FIGS. 1-4. As noted in the Background, a CMH light source is often best operated in a horizontal plane. This transverse mounting allows the light source to remain horizontal for all possible orientations of the axis of revolution of the reflector is intended to be mounted in a vertical direction.

More specifically, as shown in FIG. 4, the ferrules or first frame portions 64 (left-hand portions are substantially identical to the right-hand portions unless noted to the contrary) extend upwardly through the base of the reflector and generally parallel to the axis AR. As will be appreciated from examining FIG. 3, the first frame portions 64 include distinct portions, namely linear, first portions 64*a*, angled, second portions 64*b*, and offset linear, third portions 64*c*. The first frame portions then are bent at one end through approximately ninety degrees to merge into second frame portions 66 (FIG. 2). These bends in the frame portions provide rigidity and robustness to the assembly, so that the capsule is held at the desired location in the cavity of the reflector. The second portions 66 generally extend along a major portion of the length of the capsule as represented in FIGS. 1 and 2.

At an end 66*a* of the second portions remote from the bend connection with first portions 64*c*, one of the second portions (shown in FIG. 1 as the left-hand portion 66*a*) supports the sealed end 44 of the capsule. Specifically, a strap 70 is secured adjacent to the end 66*a* and is wrapped about the sealed end of the capsule. Further, an intermediate support member such as wire 72 extends from a mediate location along the other of the second portions (shown here as the right-hand portion in FIG. 1) and is preferably wrapped around the perimeter of the capsule at a location spaced from the central body of the CMH light source.

Figure 2:
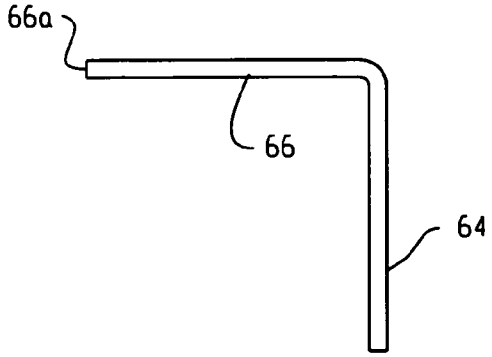
FIG. 2 is a front view of the right-hand frame support for a transverse mounted arctube for a PAR56 lamp.
Figure 3:
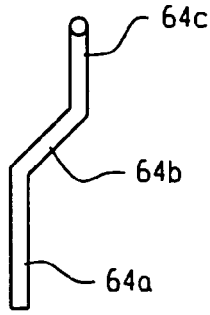
FIG. 3 is a side view of the right-hand frame support of FIG. 2.

As is best shown in FIG. 1, the frame portions also provide an electrical connection with the light source in addition to the mechanical support described in the preceding paragraphs. Particularly, wire interconnects 76, 78 are preferably wrapped and/or spot welded to the outer leads 46, 48, respectively. The wire interconnects 76, 78 are sufficiently small that they do not really add to the mechanical support within the reflector, however, they assure an electrical connection with the leads of the light source.

In this manner, the light source is effectively supported in the PAR lamp in a transverse manner so that the overall extended length of the 150 W CMH light source capsule can be received in a PAR56 reflector. Likewise, the electrical connection is assured in this arrangement, and the body of the light source is accurately located at the focal point of the reflector. It has the further advantage of providing a robust mechanical support in part due to the bends in the frame portions that limit the transfer of forces therethrough.

Figure 5:
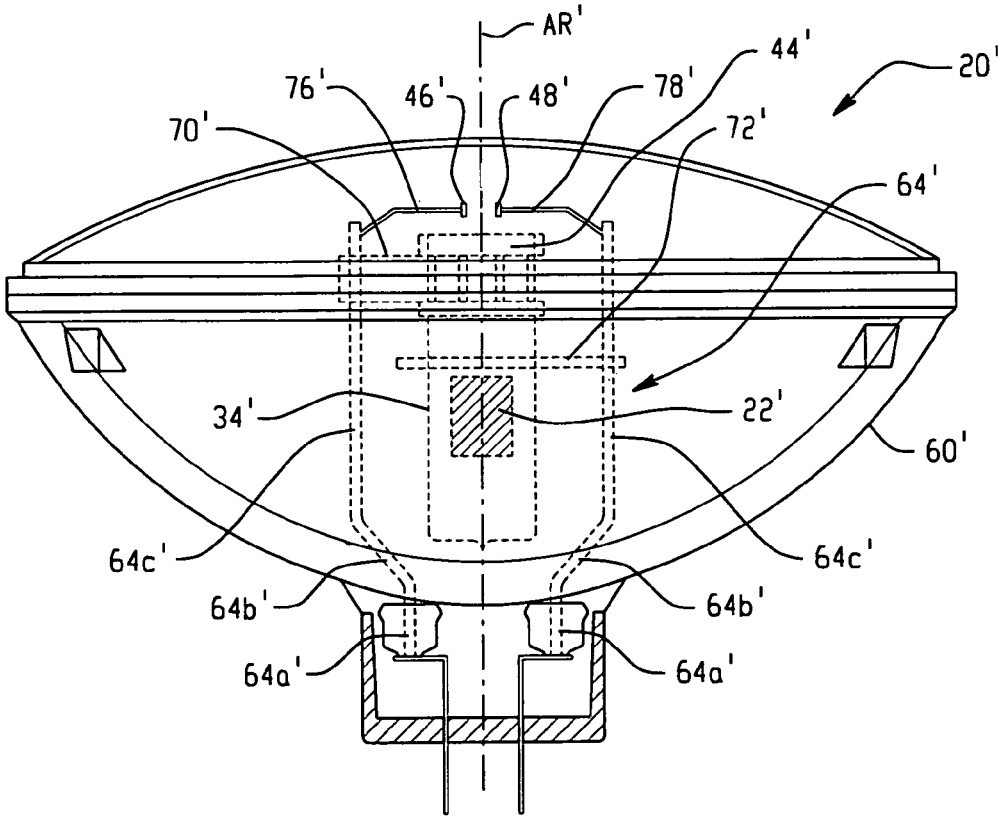
FIG. 5 is a side view of a PAR64 lamp with an axially mounted arctube capsule.

In FIG. 5, a PAR64 lamp assembly is illustrated. Although the 150 W CMH light source is still preferred, the dimension from the base of the reflector toward the outer perimeter at the outer end of the reflector has a sufficient length to accommodate the light source capsule. Accordingly, the support may be modified to permit the light source to be mounted parallel to the axis of revolution of the reflector. For purposes of simplicity and comparison, similar reference numerals with a primed suffix (') are used to identify similar components. Substantially the same frame 62' may be used. Note the similar first frame portion 64 that includes three distinct regions 64*a*', 64*b*', and 64*c*' that extend in vertical, angular and offset vertical portions from the base of the reflector 60'. Rather than bending ninety degrees as in the embodiment of FIGS. 1-4, the frame 62' continues in linear fashion along either side of the arctube capsule 34'. Again, a strap 70' extends from one of the frames (here identified as 64' since there is no need to bend the frame ninety degrees. Likewise, a support wire 72' extends in supporting relation from the other frame 64' (right-hand frame), is preferably wrapped around the capsule, and secured such as by spotweld to the frame 64'. Further, the same electrical connection is assured with the wires 76', 78' interposed between the leads 46', 48' and the frames 64'.

In order to obtain a good beam pattern from a PAR reflector, the light source must be accurately positioned on the axis of the lamp and at the correct distance from the back of the reflector. This is easily achieved with an axially mounted arctube as shown in FIG. 5. While the length of the arc along the lamp axis causes some distortion of the ideal beam pattern, this also results in the performance being less sensitive to positioning of the source light center length with respect to the back of the reflector.

For the transverse mounted arctube of FIGS. 1-4, the mount design ensures that the light source is positioned on the axis of the lamp and at the correct distance from the back of the reflector. This new mount design achieves correct positioning of the light source by shape and size of the frame wires. The mounts are created with excellent precision using a welding jig that holds the arctube and fame wires in the correct position during welding. These mounts are then inserted into the PAR and brazed in place. The mount is robust with respect to failure, that is strong and balanced to minimize stress, and robust with respect to performance. The light source is centered with respect to vertical member of the frame in both x and y directions to assure the light source is coaxial to the reflector.

What is claimed is:

1. A ceramic metal halide lamp assembly comprising:

a ceramic metal halide light source including a discharge chamber receiving first and second spaced electrodes that are in electrical communication with first and second leads and received within a light transmissive, sealed capsule, the light source having an elongated, first axial dimension;

a shallow parabolic reflector having a focal point located along an axis of revolution of the reflector and between a base end of the reflector and an open end of the reflector, the reflector having a reflecting surface adapted to receive light from the light source and direct the light in a predetermined manner through the open end of the reflector, the reflector having a second, depth dimension measured along the axis of revolution wherein the second dimension is less than the first dimension of the light source;

the light source disposed at the focal point of the reflector and the first axial dimension of the light source being disposed substantially perpendicular to the axis of the reflector; and first and second frame members extending from the reflector on opposite sides of the light source, each frame member having a first linear portion extending through the reflector surface in a first direction (z direction) generally parallel to the axis of revolution, a second linear portion extending in a second direction (y direction) substantially perpendicular to the first portion, and a third portion interposed between the first and second portions, the third linear portion extending in a third direction (x direction) to accommodate a cross-sectional dimension of the light source and capsule disposed between the second portions of the first and second frame members, the frame members generally extending adjacent to and substantially parallel to a major length portion of the light source.

2. The lamp assembly of claim 1 wherein the CMH light source is rated at about 150 W.

3. The lamp assembly of claim 2 wherein the reflector is a PAR56 reflector.

4. The lamp assembly of claim 1 wherein the reflector is a PAR56 reflector.

5. The lamp assembly of claim 1 wherein the sealed capsule receiving the light source is single-ended.

6. The lamp assembly of claim 1 wherein the first and second electrodes are axially aligned and extend from opposite ends of the discharge chamber, each electrode mechanically and electrically connected to inner leads, which are connected to molybdenum foil portions electrically connected to outer leads extending from a first end of the sealed capsule.

7. The lamp assembly of claim 6 wherein the capsule is held between the first and second support members by third and fourth support members extending from the first and second support members, respectively, in perimeter-surrounding relation with the capsule at spaced locations.

8. The lamp assembly of claim 7 wherein the third and fourth members are both received around the capsule between a first end of the capsule and the focal point.

9. The lamp assembly of claim 1 wherein the elongated CMH light source has first and second legs extending from axial opposite ends of the discharge chamber.

10. A ceramic metal halide (CMH) 150 W lamp assembly comprising:

a ceramic metal halide light source including a discharge chamber receiving first and second spaced electrodes that are in electrical communication with first and second leads and received within a light transmissive, sealed capsule, wherein the sealed capsule receiving the light source is single-ended;

a shallow parabolic PAR64 reflector having a focal point located along an axis of revolution of the reflector and between a base end of the reflector and an open end of the reflector, the reflector having a reflecting surface adapted to receive light from the light source and direct the light in a predetermined manner through the open end of the reflector; and the light source disposed substantially parallel to the axis of revolution of the reflector at the focal point thereof, wherein the light source is located between first and second frame members each having a first portion extending through the reflector surface in a first direction (z direction) generally parallel to the axis of revolution, and wherein the capsule is held between the first and second support members by third and fourth support members extending from the first and second support members, respectively, in perimeter-surrounding relation with the capsule at spaced locations.

11. The lamp assembly of claim 10 wherein the light source electrodes are aligned with the axis of revolution of the reflector.

12. The lamp assembly of claim 1 wherein the third and fourth members are both received around the capsule between a first end of the capsule and the focal point.

* * * * *